US006771782B2

(12) United States Patent
Nakamichi

(10) Patent No.: US 6,771,782 B2
(45) Date of Patent: Aug. 3, 2004

(54) SIGNAL PROCESSING FOR AUDIO DEVICE

(75) Inventor: Niro Nakamichi, Tokyo (JP)

(73) Assignee: Mechanical Research Corporation, Tokyo (JP)

( * ) Notice: Subject to any disclaimer, the term of this patent is extended or adjusted under 35 U.S.C. 154(b) by 716 days.

(21) Appl. No.: 09/741,385

(22) Filed: Dec. 20, 2000

(65) Prior Publication Data

US 2001/0005416 A1 Jun. 28, 2001

(30) Foreign Application Priority Data

Dec. 24, 1999 (JP) ..... 11-366161

(51) Int. Cl.[7] ..... H04R 1/02
(52) U.S. Cl. ..... 381/87; 381/386

(58) Field of Search ..... 381/87, 300, 55, 381/335, 162, 182, 386, 395, 189; 181/150, 198, 199

(56) References Cited

U.S. PATENT DOCUMENTS 5,802,194 A * 9/1998 Yamagishi et al. ..... 381/386
6,005,642 A * 12/1999 Meisner et al. ..... 381/386

* cited by examiner

*Primary Examiner*—Stella Woo
(74) *Attorney, Agent, or Firm*—Darby & Darby

(57) ABSTRACT

The impact of disturbances on the amplifier parts for the L and R channels is reduced by attaching the cases for the L and R channels, spaced apart, to the case for the power supply. Only the relatively massive power supply is directly supported on a supporting surface. Independent support on the supporting surface of the signal processing parts of the L and R channel is omitted.

4 Claims, 2 Drawing Sheets

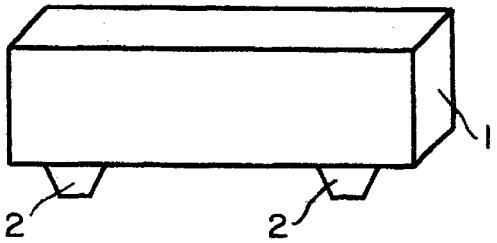
FIG. 1
PRIOR ART
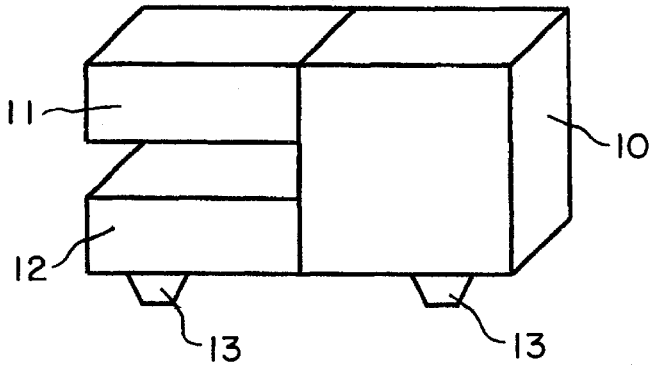
FIG. 2
PRIOR ART
FIG. 3
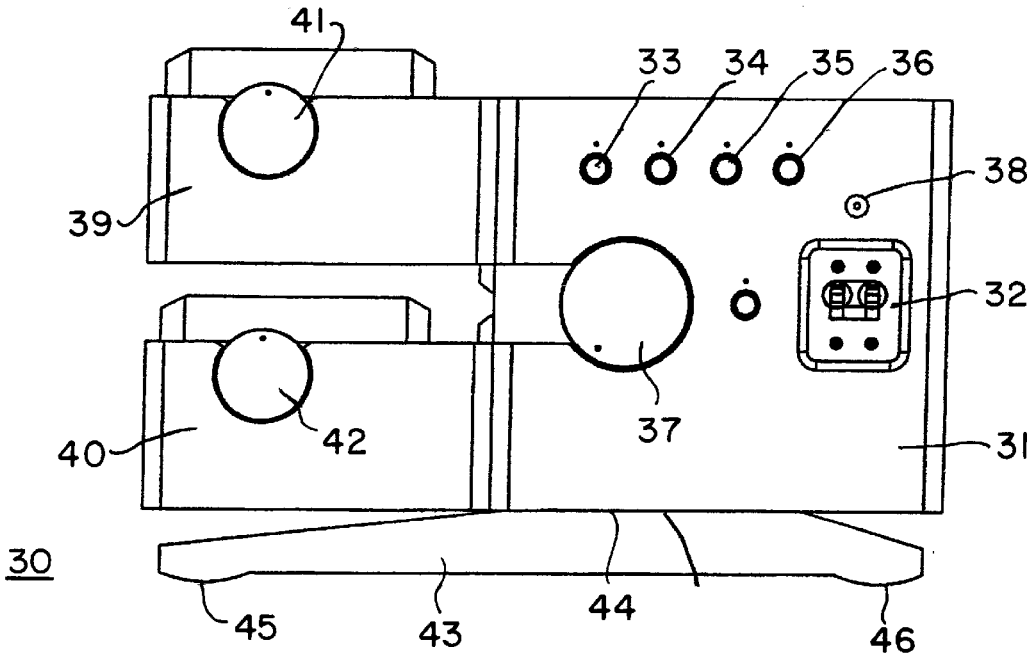

SIGNAL PROCESSING FOR AUDIO DEVICE

BACKGROUND TO THE INVENTION

The present invention relates to an audio device equipped with a signal processing circuit that transmits the audio signal of the L channel and R channel.

When a current flows inside a circuit, an electromagnetic field is generated having a strength proportional to the current. The electromagnetic field produces a force on nearby magnetic substances, and a current in nearby conductors. In electrical circuits for audio devices such as pre-amps and the like that perform signal processing such as signal amplification and the like, even an electrical circuit containing only a single circuit pattern on a circuit board, the flow of current can produce complex interferences which can produce distortion of the audio signal. Large electromagnetic fields are generated in the vicinity of the power transformer and choke coil, and other components, that make up the power supply for the audio device.

In the prior art, there have been schemes for the layout of circuit patterns and the layout of the electronic parts in ways to attempt to avoid the negative impact of electromagnetic fields.

Referring to FIG. 1, for blocking the power source part and the amplifier parts, the power source part and the amplifier parts for the L, R (left and right) channels are each blocked and laid out in a plane inside a generic six-sided case body 1. Legs 2 for supporting are attached to the four corners of the bottom surface. With this construction, it is difficult to prevent interference among the power source part and amplifier parts.

A further possibility is to have separate cases for the power source and each amplifier and to integrate these into a single unit. Referring to FIG. 2, a case unit 11 houses the amplifier parts for one of the L and R channels. A case unit 12 houses the amplifier parts for the other of the L and R channels. Case units 11 and 12 are attached spaced apart on one side of a case unit 10 that houses the power source part. Legs 13 for supporting are attached as in the prior art to the four corners of the bottom surface portion. The bottom surface portion includes the bottom surfaces of case unit 10 and case unit 12, which house the power source part and the lower R channel, respectively. In this device, the amplifier 11 is cantilevered, but the amplifier 12 is supported on a supporting surface by legs 13 However, there are problems with this construction. Physical disturbances such as mechanical vibrations and the like may be transmitted from the case unit 10 to both case units 11 and 12 by the direct mounting of these case units on case unit 10. However, since case unit 11 is cantilevered, and case unit 12 is directly supported on a supporting surface, a substantial difference exists in the transmission of vibration to the two case units. That is, vibration is damped by the mass of the relatively heavy components in case unit 10, thereby reducing the transmission of vibration to the cantilevered amplifier 11. However, vibration is directly applied from the legs 13 to the amplifier 12, without damping by the mass of case unit 10. The vibrations may be transmitted to the amplifier parts that are the transmission paths for the audio signal. The impact of disturbances and the like is not balanced between the amplifier parts of the L and R channels. That is, case unit 11 is cantilevered on case unit 10, whereas case unit 12 is at least partly supported on legs 13. Consequently, vibrations tend to act differently on case units 11 and 12. This is not ideal.

The amplifier parts for the L and R channels are attached in a separated condition to a power source part onto which a means for support is attached. However, the amplifier parts for the L and R channels are generally not both supported independently on a supporting surface.

OBJECTS AND SUMMARY OF THE INVENTION

It is an object of the invention to provide and audio amplifier which avoids interference from the transmission of vibration to its L and R channel amplifiers.

It is a further object of the invention to provide an audio amplifier in which only the power source part is directly supported on a supporting surface. The L and R amplifier parts are both cantilevered from the power source part to take advantage of the damping of mechanical vibration occurring in the relatively massive components of the power source part.

It is a further object of the invention to provide and audio amplifier having roughly equal transmission of vibration to its L and R amplifier parts. This is accomplished by cantilevering separate cases for the L and R amplifier parts to the side of the power source part. Only the power source part is supported on a supporting surface. The relatively massive power source part damps vibrations from the supporting surface, thus reducing the transmission of vibration to the L and R amplifier parts.

Briefly stated, the present invention provides an audio device in which the impact of mechanical disturbances on the amplifier parts for the L and R channels is reduced by cantilevering the cases for the L and R channels, spaced apart, to the case for the power supply. Only the relatively massive power supply is directly supported on a supporting surface. Independent support on the supporting surface of the signal processing parts of the L and R channel is omitted.

According to an embodiment of the invention, there is provided an audio device, comprising: a power source part that houses power source components, an L channel signal processing part and an R channel signal processing part that transmit and process audio signals of L channel and R channel, the L and R channel signal processing parts being housed in separate case units independent from each other, cases of the L channel and R channel signal processing parts are attached, spaced apart, to the power source part, means for supporting the audio device on a supporting surface, and only said power source part is directly supported by the means for supporting on a supporting surface, while the L channel and said R channel signal processing parts are supported cantilevered on the power source part, whereby transmission of vibration to the L channel and the R channel signal processing parts is substantially reduced.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is an external perspective view of an amplifier of the prior art.

FIG. 2 is an external perspective view of an amplifier to which reference will be made in describing the prior art and an embodiment of the present invention.

FIG. 3 is a front view of an amplifier according to an embodiment of the invention.

DESCRIPTION OF THE PREFERRED EMBODIMENTS

Figure 4:
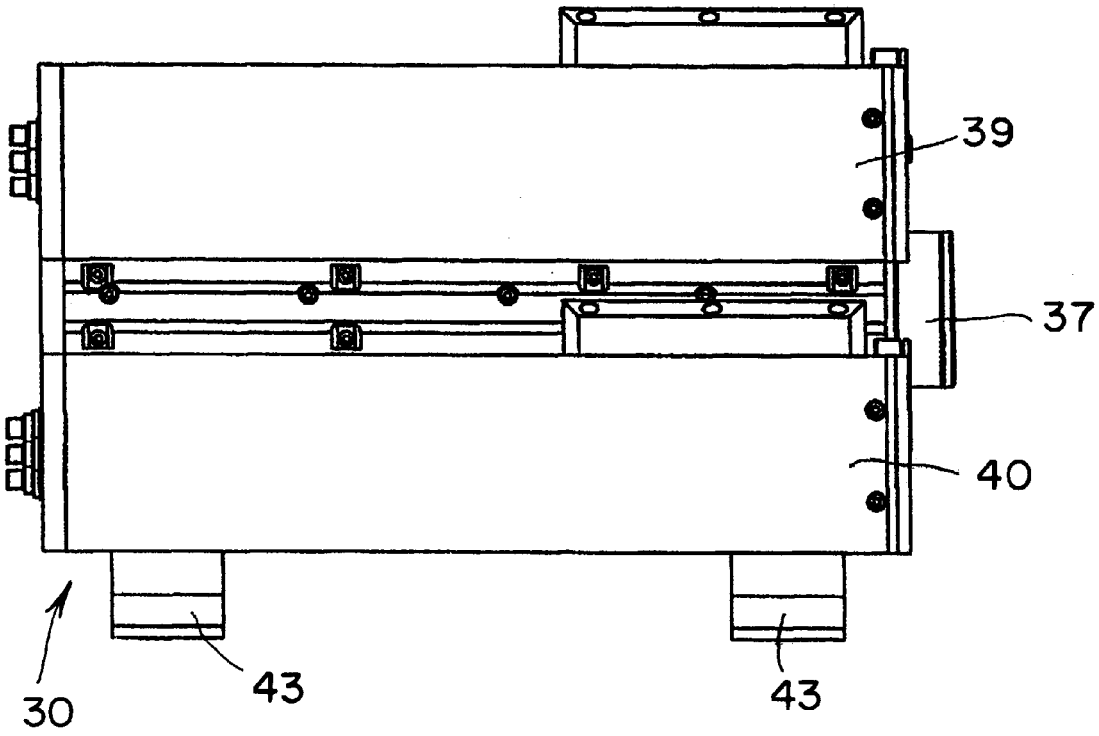
FIG. 4 is a side view of the amplifier of FIG. 3.

Referring to FIGS. 3 and 4, a power source part 31 contains a board on which are mounted circuit components such as power transformer, condenser, choke coil, and the like. The front surface of the power source part has accessible thereon suitable controls such as, for example, a power switch 32, switches 33–36 for line switching, a master volume control 37, an indicator 38.

Amplifier part 39 and amplifier part 40 separately perform signal processing and transmission of the L channel signal and R channel signals. Amplifier part 39 and amplifier part 40 have their own separate casings which are separately attached on the left side surface of power source part 31. Power is supplied to the amplifier circuits and the like that are housed in amplifier part 39 and amplifier part 40 from power source part 31 via wires and the like. Volume control 41 and volume control 42 on the front surface of amplifier part 39 and amplifier part 40 are linked with the master volume control 37. However, since this linking of volume controls is not particularly related to the contents of the present invention, the detailed description is omitted.

Legs 43 provide support for the pre-amp 30 on a supporting surface. Legs 43 are asymmetrical with a mounting surface 44 for mounting pre-amp 30 biased in the direction of the power source part 31. Thus, as shown, legs 43 contact directly only along mounting surface 44 which only contacts the bottom of power source part 31, and does not directly contact the bottom of amplifier part 40. Bottom contacts 45 of legs 43 rest on a supporting surface at points near the outer extremities of amplifier part 40. Bottom contacts 46 of legs 43 rest on a supporting surface at points near the outer extremities of power source part 31. Since the transformers, etc., in power source part 31 are heavier than the circuit components in amplifier parts 39 and 40, a suitable mechanical balance can be achieved to place substantially equal forces on bottom contacts 45 and the bottom contacts 46, even though the mounting surfaces 44 of the legs 43 are biased toward the power source part. The side bases of amplifier parts 39 and 40 are affixed to the side surface of power source part 31. Thus, both amplifier parts 39 and 40 are cantilevered in a roughly equal way. Thus vibration transmission to amplifier parts 39 and 40 should be roughly the same. The positioning of heavy components in power source part 31 can be selected to produce a balanced pre-amp 30, even though the mounting surface is biased far enough in the direction of the power source part that the amplifier part 40 is not directly supported, but instead is cantilevered in a manner similar to amplifier part 39. Having the support bottom supports points of the legs 43 positioned below the four corners of the bottom surface of the integrated case body, permit legs 43 to support the case body in a stable manner.

With this construction, physical disturbances such as vibrations and the like that come through the supporting legs are transmitted to the power source part which houses heavy objects such as the transformer and the like. The direct transmission of these physical disturbances and the like to the amplifier parts, which are the transmission paths for the audio signals, is reduced because of the large mass of the components in power source part 31, and the deterioration of sound quality due to disturbances and the like is effectively prevented.

The present embodiment has a construction wherein each amplifier part is attached in a separated condition to the left side wall of the power source, but the present invention is not limited to this embodiment. The amplifier parts 39 and 40 can be attached to the left and right side walls of the power source part 31 without departing from the spirit and scope of the present invention.

As described above, according to the present invention, with an amplifier that uses a blocked construction, the impact of disturbances and the like on the amplifier parts which are the transmission paths for the audio signal are suppressed, and the deterioration in sound quality is effectively prevented.

Having described preferred embodiments of the present invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An audio device, comprising:

a power source part that houses the power source components;

an L channel signal processing part and an R channel signal processing part that transmit and process audio signals of L channel and R channel;

said L and R channel signal processing parts being housed in separate case units independent from each other;

cases of said L channel and R channel signal processing parts are cantilevered, spaced apart, to said power source part;

means for supporting said audio device on a supporting surface; and said means for supporting directly supporting only said power source part on a supporting surface and said means for supporting being asymmetrically shaped with respect to said support surface, while said L channel and said R channel signal processing parts are supported cantilevered on said power source part, whereby transmission of vibration to said L channel and said R channel signal processing parts is substantially reduced.

2. An audio device as described in claim 1, wherein:

cases of said L channel and R channel signal processing parts are affixed to the same side of said power source part.

3. An audio device as described in claim 2, wherein:

a support surface of said means for supporting extends over a portion of a plane of projection of at least one of said L channel and said R channel signal processing parts attached only to a side surface of said power source part.

4. An audio device, comprising:

a power source part that houses the power source components;

an L channel signal processing part and an R channel signal processing part that transmit and process audio signals of L channel and R channel;

said L and R channel signal processing parts being housed in separate case units independent from each other;

cases of said L channel and R channel signal processing parts are cantilevered, spaced apart, to said power source part and are affixed to the same side of said power source part;

means for supporting said audio device on a supporting surface;

a support surface of said means for supporting extends over a portion of a plane of projection of at least one of said L channel and said R channel signal processing part parts attached only to a side surface of said power source part; and said means for supporting directly supporting only said power source part on a supporting surface, while said L channel and said R channel signal processing parts are supported cantilevered on said power source part, whereby transmission of vibration to said L channel and said R channel signal processing parts is substantially reduced.

* * * * *